United States Patent [19]

Gulker et al.

[11] Patent Number: 4,886,388

[45] Date of Patent: Dec. 12, 1989

[54] CLEANSER DISPENSING SPONGE SYSTEM

[76] Inventors: Stuart P. Gulker, Stone Hill Rd., Pound Ridge, N.Y. 10576; Stanley Gulker, 6 Mark Dr., Spring Valley, N.Y. 10977

[21] Appl. No.: 225,640

[22] Filed: Jul. 28, 1988

Related U.S. Application Data

[63] Continuation-in-part of Ser. No. 37,524, Apr. 13, 1987, abandoned.

[51] Int. Cl.[4] ..... B43M 11/06; A47L 13/26

[52] U.S. Cl. ..... 401/148; 401/196; 401/205; 401/206; 401/207

[58] Field of Search ..... 401/148, 203, 204, 205, 401/206, 207, 184, 196, 202, 151; 15/244 R

[56] References Cited

U.S. PATENT DOCUMENTS

| | | | |
|---|---|---|---|
| 673,918 | 5/1901 | Murray | 401/205 |
| 801,087 | 10/1905 | Kahn | 401/202 |
| 802,627 | 10/1905 | Chrysler et al. | 401/148 |
| 1,243,967 | 10/1917 | Nielsen | 401/148 |
| 2,095,423 | 10/1937 | Tilley | 401/207 |
| 2,418,035 | 3/1947 | LaChapelle | 401/148 |
| 2,976,560 | 3/1961 | Turner | 15/569 |
| 3,058,139 | 10/1962 | Dryden | 15/244 R |
| 3,128,493 | 4/1964 | Paul | 401/184 |
| 3,187,365 | 6/1965 | Paul | 401/207 X |
| 3,938,898 | 2/1976 | Reitknecht | 401/207 X |
| 4,078,865 | 3/1978 | Moser | 401/23 |
| 4,155,139 | 5/1979 | Corcoran | 15/244 R |
| 4,415,288 | 11/1983 | Gordon | 401/132 |
| 4,432,749 | 2/1984 | Snyder | 401/185 X |
| 4,451,164 | 5/1984 | Roberts, Jr. | 401/196 |
| 4,483,636 | 11/1984 | Meyer | 401/266 |
| 4,504,994 | 3/1985 | Johnston | 15/244 R X |
| 4,609,301 | 9/1986 | Benarrouch | 401/196 |

FOREIGN PATENT DOCUMENTS

| | | | |
|---|---|---|---|
| 1069465 | 2/1954 | France | 401/203 |
| 1142591 | 9/1957 | France | 401/207 |
| 893496 | 4/1962 | United Kingdom | 401/203 |

OTHER PUBLICATIONS

Drawings & Photos of a Sponge-and-Handle Soap Dispenser Commercially Available, as Shown in Separate Papers, "Interaction Disclosure Statement" of 4/10/1987.

*Primary Examiner*—Steven A. Bratlie
*Attorney, Agent, or Firm*—Robert A. Seemann

[57] ABSTRACT

A cleanser dispensing sponge including a housing having a reservoir with an opening for receiving cleanser concentrate, a head, and a cleanser delivery system comprising a pumping canal having a first opening through an outer surface of the head, and a second opening being in fluid transmitting communication with the reservoir, the second opening including a metering constriction for controlling liquid flow between the system and the sponge, the first opening including a back flow constriction for controlling liquid flow between the system and resilient, fluid conducting sponge means mounted on the head. Support ribs on the head resist bending and rotation of the mounted sponge means. Sealing means for the reservoir opening includes a recess for enclosing air within the sealed reservoir.

4 Claims, 2 Drawing Sheets

FIG. 3
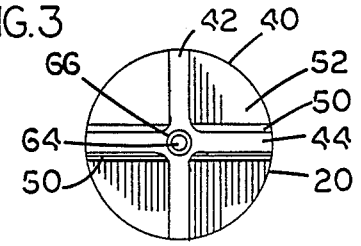
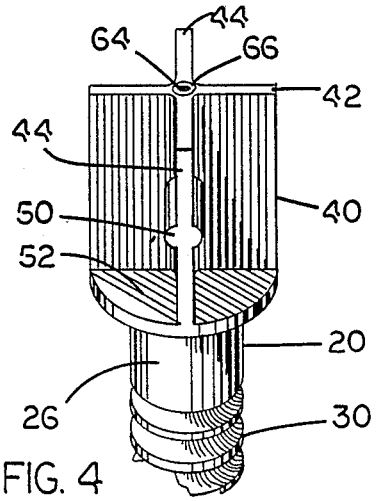
FIG. 4
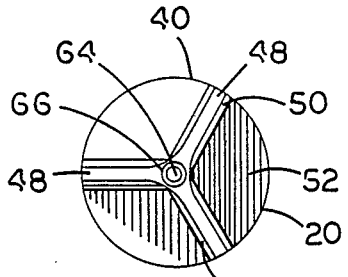
FIG. 5
FIG. 6
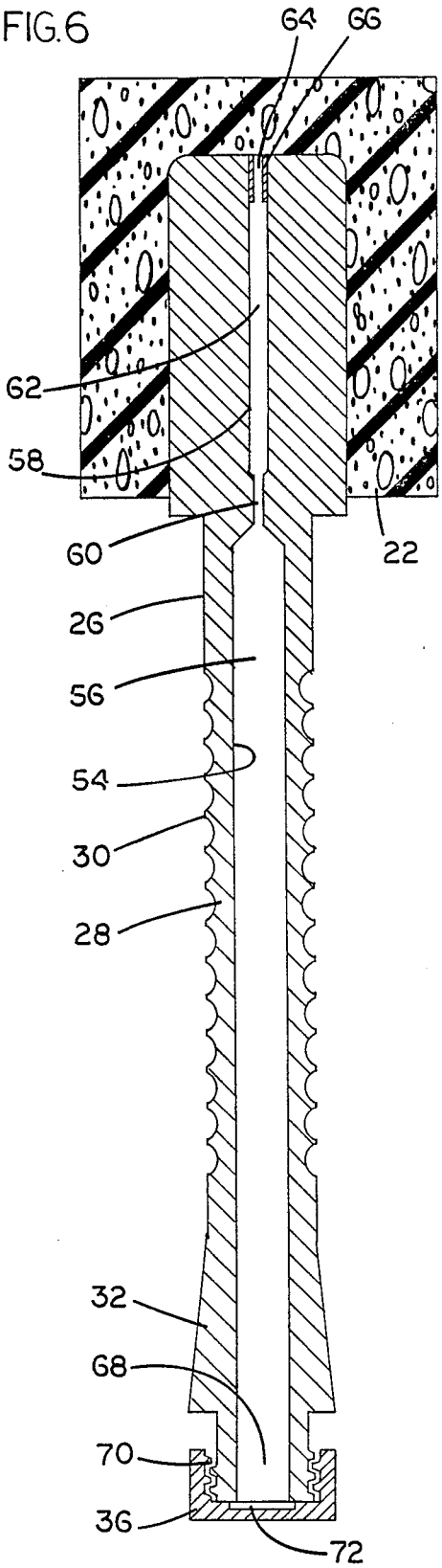

CLEANSER DISPENSING SPONGE SYSTEM

This application is a continuation-in-part of application Ser. No. 037,524, filed Apr. 13, 1987, now abandoned.

BACKGROUND OF THE INVENTION

1. Field of the Invention

The present invention relates in general to dispensers or coating applicators with integral material supply, more specifically to a hand-held cleanser dispensing sponge apparatus which dispenses soap, detergent or other cleanser from a self-contained reservoir.

2. Description of the Prior Art

There are two types of cleanser dispensing sponges, the type for use with water, such as a dish washing aid, and the type used to apply a coating exclusive of an external liquid, such as a self dispensing surgical swab.

The majority of cleanser dispensing sponges, including those for use as dish washing aids operate by dispensing the liquid to the sponge without the assistance of, or in automatic response to work with an external liquid, or workload demand.

Sponges, for example, are supplied with liquid from a reservoir by squeezing the reservoir which is flexible, such as in U.S. Pat. No. 4,432,749 awarded to Snyder et al., or as in U.S. Pat. No. 4,078,865 awarded to Moser, and U.S. Pat. No. 4,609,301 awarded to Bennarouch, wherein it is delivered from the reservoir by gravity.

In U.S. Pat. No. 4,415,288, awarded to Gordon et al., either gravity feed or squeezing the sides of an insertable reservoir is used to force the liquid into the sponge. A resiliently deformable reservoir is squeezed in Turner, U.S. Pat. No. 2,976,560, and in Meyer, U.S. Pat. No. 4,483,636.

When used with water, such as in cleaning dishes, presently available cleanser dispensing sponges tend to use an excessive amount of soap in a manner unrelated to the work load, because they are manually pumped as described above. Additionally, when handled under water they often rapidly loose their concentrated cleanser supply through accidental deformation of the pumping surface due to swishing of the device therein, by back flush or by rapid diffusion through the sponge.

In order to maintain better control over concentrate dispensing or loss, present systems include moving parts such as the one way valve members used in Turner and in Snyder et al. Others use more complicated mechanisms including trigger and plunger activated pumps.

SUMMARY OF THE INVENTION

It is one object of the invention to provide a cleanser dispensing sponge which contains the material for dispensing.

It is another object of the invention to provide a cleanser dispensing sponge which automatically dispenses in response to work in progress.

Another object of the invention is to minimize cleanser concentrate loss when the dispensing sponge is left submerged.

Another object is to provide a cleanser dispensing sponge that works with liquid, powder or solid concentrates.

Another object of the invention is to provide a cleanser dispensing sponge that is easy and simple to use.

Still another object is to provide a cleanser dispensing sponge that has no costly moving elements and is relatively inexpensive to manufacture.

Other objects and advantages of the invention will become readily apparent to persons versed in the art from the ensuing description.

In accordance with the invention there is provided a cleanser dispensing sponge comprising a housing, the housing including a head and a reservoir. The reservoir including a filler opening for receiving the concentrate into the reservoir, and means for sealing the reservoir, the means for sealing including a recess for enclosing air within the sealed reservoir upon sealing.

A cleanser delivery system located within the housing includes a pumping canal having a first and a second opening, the second opening being in fluid transmitting communication with the reservoir, the first opening being through an outer surface of the head.

Resilient and fluid conducting sponge means is mounted on the head. Support ribs extending from the head are so configured so that they resist bending and rotation of the mounted sponge in response to external mechanical pressures against it.

A metering constriction is located within the second opening for controlling liquid flow between the system and the reservoir, and a rigid back flow constriction is located within the first opening for controlling liquid flow between the system and the sponge.

BRIEF DESCRIPTION OF THE DRAWINGS

In order that the invention may be more fully comprehended it will now be described, by way of example, with reference to the accompanying drawings, in which:

FIG. 3 is a left end view of a dispenser head.

FIG. 4 is $\frac{3}{4}$ view of a head.

FIG. 5 is a left end view of a dispenser head with three support ribs.

FIG. 6 is a front cross sectional view of one embodiment of the cleanser dispensing sponge, showing its cleanser delivery system.

DESCRIPTION OF THE PREFERRED EMBODIMENTS

Figure 1:
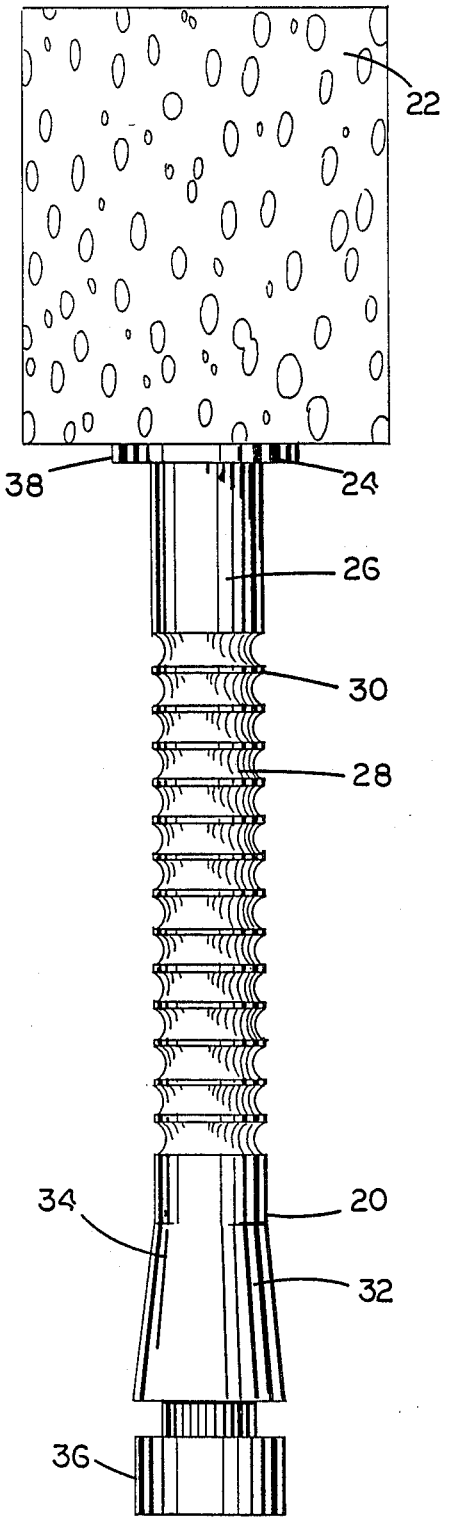
FIG. 1 is a pictorial view showing a dispenser with a sponge mounted.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

The invention will now be described in more detail, with respect to the figures in which like elements have the same numbers. Referring to FIG. 1, there is shown one embodiment of the cleanser dispensing sponge 20. Sponge 22 is mounted at the front end 24 of housing 26. Housing 26 includes handle portion 28 having holding ribs 30, and at the back end of the housing, also provides a mechanical stop for slipped-on sponge 22.

Figure 2:
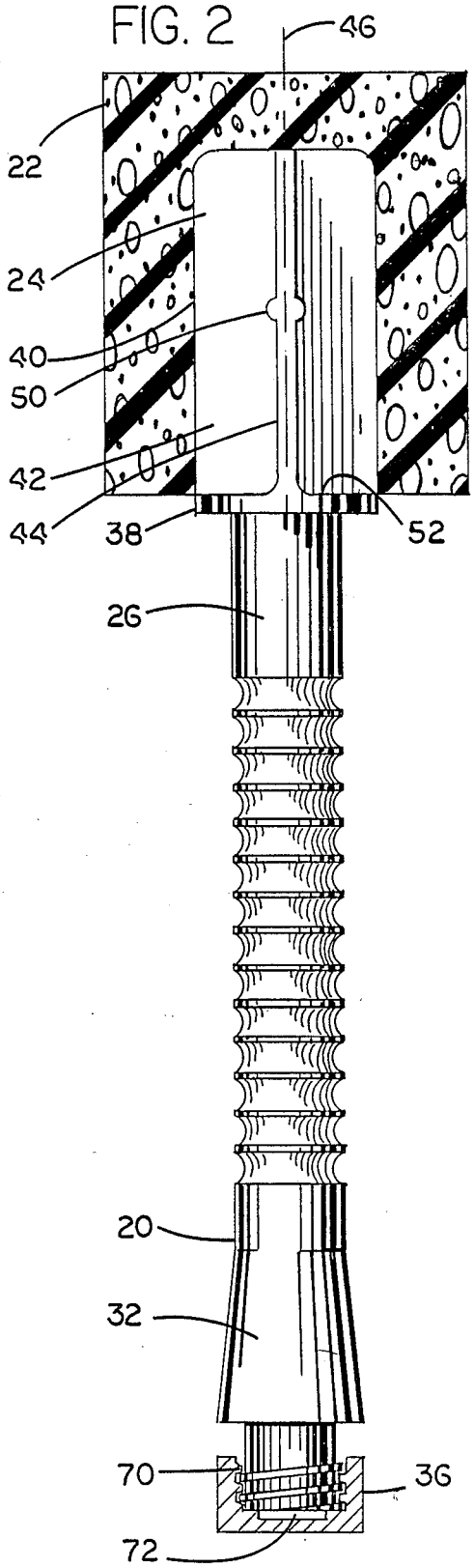
FIG. 2 is a top view of a dispenser with the sponge and sealing cap in cross section.

Sponge 22 seen mounted on head 40 of front end 24 of housing 26, in FIG. 2, is located on opposed horizontal ribs 42 and opposed vertical ribs 44 (FIGS. 3 and 4) of the head. The ribs extending each along a substantial portion of the head, substantially parallel and radial to longitudinal axis 46 of the head, provide longitudinal and transverse mechanical support for the sponge to help resist external pressures tending to bend or rotate the sponge around the longitudinal axis 46 of the head. Although the sponge supporting ribs 42 and 44 are shown to be at about 90 degrees to one another, they can reasonably perform the described stabilizing service for the mounted sponge when one or more rib is angled at an acute angle such as 30 degrees, or an obtuse angle approaching 180 degrees from a neighbor. It is within the contemplation of the invention to include one or more ribs angled from a neighboring rib within the range of about 15 degrees to that of a straight angle, and to have head 40 comprise only three ribs as may be seen in FIG. 5.

Retaining ribs 50 on vertical support ribs 44 aid in preventing the central portion of the sponge which is relatively resilient, from slipping forward and backward on the head to which it is directly mounted, and to help retain the sponge on the head. Because the sponge is mounted directly on the head as shown in FIGS. 2 and 6, that is, mounted without an intervening support frame, waterproof glue may also be used to more securely retain the sponge on the head. A slow hardening glue is preferable if it is applied to the support ribs, in order to allow time for the sponge to be slid on, back to the front facing support surface 52 of stop 38. Alternatively, for quick assembly, a quick glue such as contact cement, or cyanoacrylate such as Krazy Glue brand is used alone, on front face 52 to permit quick and easy slippage of the sponge back to the face with almost instant fastening.

Referring now to FIG. 6, housing 26 includes a hollowed out portion 54 within handle portion 28, which serves as a reservoir 56 for the cleanser. The cleanser may comprise liquid, granular or solid rod form for soaping the sponge, owing to cleanser delivery system 58 which will will now be discussed.

Head 40's cleanser delivery system 58 includes metering constriction 60, connected to reservoir 56. Forward of pumping canal 62 is located back flow constriction 64 which is installed in orifice 66. Back flow constriction 64, is rigid, that is, it will not move or flex longitudinally in response to pressure from the sponge or from cleanser flow. It defines an orifice which preferably is longer than the radial height of the constriction, as shown in FIG. 6.

The entire housing, but for back flow constriction 64, is molded in a single unit by techniques known to the plastic molding art. Because metering constriction 60 and pumping canal 62 are generally formed by a single pin during molding, back flow constriction 64 is established by a press-fit insert, ultrasonic plastic deformation of orifice 66 with a formed horn, or other post molding method. Metering constriction 60, which is molded with the head defines an orifice which preferably is longer than the radial height of the constriction, as shown in FIG. 6, and therefore it will not effectively move or flex longitudinally in response to pressure from the sponge or from cleanser flow. Pumping canal 62, also formed by the head, preferably has its length longer than its diameter, as shown in FIG. 6, and therfore is not suitable to longitudinal flexing.

The sponge is made from a resilient material which permits longitudinal and transverse conduction of liquid through itself in response to moderate hydraulic forces and, which may also engender a self wicking action in one or more directions. These characteristics are variously produced by natural sponge and sponge substitute materials known to the art such as open cell foam, felts and woven fabrics.

Sealing cap 36 at the back end of housing 32 is fastened over filler opening 68 by means of threads 70. The cap includes recess 72 for a reason which will be explained later.

Before use, the filler cap is removed from the handle and cleanser in the form of a powder, liquid or solid is loaded into the reservoir. If the solid cleanser is highly concentrated, it is shaped to closely fit the walls of the hollowed out portion. If it is less concentrated, it is formed with portions of its diameter smaller than the hollowed out portion's inner diameter. In order to assure proper start up with powders and solids, the reservoir is first filled with water which is allowed to travel down through cleanser delivery system 58, to the sponge. The remaining water is then poured out of the reservoir, and the cleanser is loaded in. Priming with water is not necessary when a liquid cleanser is used unless its consistency will not permit it to similarly fill the cleanser delivery system.

Once the reservoir is loaded, the filler cap is sealingly replaced on the handle. With cleanser in the handle and either water or cleanser located in the cleanser delivery system, the sponge is then thoroughly wetted, either by submersion in water, or by holding it under a stream of water.

In use, the sponge is normally swished or dunked in water, and pressingly rubbed on the surfaces to be cleaned. Each of these intermittent operations generates pressure gradients within the liquid filled sponge. These gradients in turn establish a minor pumping action on the liquid that is within the cleanser delivery system. The pumping action translates to small forward and backward movements of the liquid within the cleanser delivery system. Each backward movement forces a small amount of liquid from the cleanser delivery system, back through metering constriction 60, into reservoir 56, where it comes into contact with the cleanser, dilutng a small portion of the cleanser near the metering constriction. Each forward movement of the liquid in the cleanser delivery system, draws a small amount of the diluted cleanser into the metering system, where it gradually mixes with the liquid in the system, increasing its cleanser concentration. Air, trapped in the reservoir, aids in liquid flux to and fro between the reservoir and system, due to its compressibility.

The air is caught in the reservoir when it is filled to less than its absolute capacity and, by recess 72 in the cap. The recessed cap may be provided as an extra precaution beyond instruction to the user to fill to some level below the edge of the filler opening.

Beyond controlling the amount of flow between the cleanser delivery system and the reservoir in response to urging of the hydraulic pumping pressure, metering constriction 60 resists spontaneous flow of the concentrated cleanser out from the reservoir. Pumping canal 62, in addition to serving as a hydraulic pumping column, also serves as an intermediate reservoir of diluted cleanser mixture.

The cleanser delivery system pumps, as explained earlier, in response to intermittent external pressures. Constant pressure has little effect. A cleanser dispensing sponge, left submerged several times longer than the length of the washing period will loose only a small fraction of the amount of cleanser used to accomplish the washing.

Cleanser, doled out from the reservoir by the delivery system is replaced with water which gradually dilutes liquid cleanser. When a solid cleanser is used, the replacing water dissolves more cleanser, thereby providing a more constant cleanser concentration in the reservoir.

Back flow constriction 64, contributes to controlled cleanser delivery, by restricting flow of the diluted cleanser mixture from the pumping canal intermediate reservoir when it is not under the influence of the pumping action, and controlling the amount of pumping action that will result from a given momentary pressure change in the region of orifice 66.

Thus, it is seen that the present invention provides a low cost-to-manufacture cleanser dispensing sponge which conserves cleanser by restricting its loss during non use periods, even if the dispenser is left submerged for much of the washing period, dispenses cleanser in direct response to the washing action without need for supplementary valves, trigger or pump, works well with liquid or solid cleansers, dispenses cleanser at a relatively constant rate, and is lightweight and simple to use.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

What is claimed is:

1. A cleanser dispensing sponge comprising:

a housing, including a first end, a second end, said first end comprising a head, said housing further including a reservoir located within the housing and occupying a substantial portion of the length of the housing between the head and the second end, with the back of the reservoir located at said second end, and the front toward said head, said reservoir including a filler opening at said second end for loading cleanser into the cleanser dispensing sponge, and rigid cap means at said second end for sealing said filler opening, sponge means for mounting on said head, said sponge means including resilient and fluid conducting properties, a cleanser delivery system located within the housing, said system comprising a pumping canal for receiving hydraulic pumping pressure from the sponge means, said canal being substantially straight, located along a line taken from the first end of the housing to the second end of the housing, and including a first opening and a second opening, said second opening being in fluid transmitting communication with the reservoir, said first opening being at said first end through an outer surface of the head within the sponge means for receiving liquid from, and for delivering liquid to, said sponge means in response to said hydraulic pumping pressure, and a metering constriction of a portion of the pumping canal, located at the second opening, for controlling liquid flow to and fro between said system and said reservoir in response to said hydraulic pumping pressure, said metering constriction defining an orifice for said second opening, said constriction being a molding with said head, and said canal being longer than its diameter, and being a molding with said head.

2. The invention described in claim 1, further comprising:

a rigid back flow constriction of a portion of the pumping canal, located within the first opening, for controlling liquid flow to and fro between said system and said sponge, said back flow constriction defining an orifice for said first opening.

3. The invention described in claims 1 or 2, further comprising:

support ribs extending from the head, being stiff and extending uninterrupted in a direction parallel to said line taken from the first end of the housing to the second end of the housing, so that they resist bending and rotation of the mounted sponge in response to external mechanical pressures against it, said sponge being mounted directly on, and glued to the head, said orifice for said second opening being longer than the radial height of the constriction, said orifice for said first opening being longer than the radial height of the constriction said cap means having a single fluid sealing surface engaging said housing.

4. The invention as described in claim 3, further comprising:

said support ribs extending each, along a substantial portion of said head, substantially parallel and radial to said line taken from the first end of the housing to the second end of the housing, and a retaining rib, substantially normal to said line, located on a support rib surface, and a radial ridge, located on the housing, over said back flow constriction, for stopping a sponge from sliding beyond the support ribs, towards the housing's second end, said cap means including a recess for including air within the sealed reservoir.

* * * * *